US009694230B2

(12) United States Patent
Cooper

(10) Patent No.: US 9,694,230 B2
(45) Date of Patent: Jul. 4, 2017

(54) MEDICINE BALL

(71) Applicant: Corey Anderson Cooper, Pittsboro, NC (US)

(72) Inventor: Corey Anderson Cooper, Pittsboro, NC (US)

( * ) Notice: Subject to any disclaimer, the term of this patent is extended or adjusted under 35 U.S.C. 154(b) by 80 days.

(21) Appl. No.: 14/823,368

(22) Filed: Aug. 11, 2015

(65) Prior Publication Data

US 2015/0343257 A1 Dec. 3, 2015

Related U.S. Application Data

(63) Continuation-in-part of application No. 14/012,300, filed on Aug. 28, 2013, now abandoned.

(51) Int. Cl.

| | |
|---|---|
| ***A63B 21/00*** | (2006.01) |
| ***A63B 21/075*** | (2006.01) |
| ***A63B 21/06*** | (2006.01) |
| ***A63B 21/072*** | (2006.01) |

(52) U.S. Cl.

CPC ..... *A63B 21/075* (2013.01); *A63B 21/0603* (2013.01); *A63B 21/0609* (2013.01); *A63B 21/072* (2013.01); *A63B 21/0722* (2015.10)

(58) Field of Classification Search

CPC ..... A63B 21/00
USPC ..... 482/148, 27, 93
See application file for complete search history.

(56) References Cited

U.S. PATENT DOCUMENTS

| | | | |
|---|---|---|---|
| 1,316,683 | A | 9/1919 | Calvert |
| 6,190,292 | B1 | 2/2001 | Panes |
| 6,629,908 | B2 | 10/2003 | Hamady |
| 6,652,421 | B1 | 11/2003 | Chen |
| 7,175,573 | B1 | 2/2007 | Huang |
| 7,326,158 | B1 | 2/2008 | Wang |
| 7,381,157 | B2 | 6/2008 | Blateri |
| 7,563,208 | B1 | 7/2009 | Chen |
| 7,762,933 | B1 | 7/2010 | Yu |
| 8,007,416 | B2 | 8/2011 | Arlie |
| 8,454,483 | B1 | 6/2013 | Bradley |
| 8,568,280 | B2 | 10/2013 | Mendoza |
| 8,840,531 | B2 | 9/2014 | Viselman |
| 8,870,719 | B2 | 10/2014 | Johnson |
| 8,944,971 | B2 | 2/2015 | Shorter |
| 2007/0135274 | A1 | 6/2007 | Blateri |

*Primary Examiner* — Jerome W Donnelly
(74) *Attorney, Agent, or Firm* — Richard C. Litman

(57) ABSTRACT

A medicine ball includes a central member with a pair of opposing concave sides. Further, convex attachments are each adapted to mate with the concave sides of the central member to form a sphere. These convex attachments are fastened together to the concave sides by a pair of fasteners, such as zippers. Additionally, attachment ports which can receive an exercise attachment are each positioned within the central member. Examples of exercise attachments include a barbell bar, a handgrip, and a pair of roller pairs, among others. In an alternative embodiment the attachment ports are positioned within the convex attachments. Further, an article of clothing has a receptacle to receive the convex attachments.

17 Claims, 8 Drawing Sheets

MEDICINE BALL

CROSS-REFERENCE TO RELATED APPLICATION

This application is a continuation-in-part of U.S. patent application Ser. No. 14/012,300, filed Aug. 28, 2013.

BACKGROUND OF THE INVENTION

1. Field of the Invention

The present invention relates to athletic equipment, and particularly to a medicine ball with an adjustable weight capacity for weight adjustment.

2. Description of the Related Art

The medicine ball was originally introduced by the ancient Greeks for therapeutic purposes, and can be used for working multiple areas of the body. As an example, the medicine ball can improve musculature, strength and coordination, as well as reduce the risk of injury. The medicine ball began as a sand filled ball, and over time was also filled with various fillers such as feathers or air. The medicine ball has evolved over the centuries into the modem medicine ball seen in gyms and fitness facilities today.

The medicine ball can be implemented with strength, aerobics, and resistance training. As an example, physical trainers in the 1800s generally used four fitness tools. One of these tools was the medicine ball, which was used to strengthen the arms, legs and core muscles. Medicine balls were also used throughout the 1930s in YMCAs, military organizations, colleges, boxing gyms and fitness gyms, among other facilities.

Medicine balls can be available in many different forms and can also be made out of various materials. For example, a medicine ball can come in different poundage, typically from about four pounds (lbs.) to about 90 lbs. One possible problem associated with the medicine ball is that each medicine ball has this specific poundage. Therefore, the user may require multiple medicine balls with different weights to perform certain exercises. This can expand the length of time to complete a workout. A possible solution to this problem is for fitness facilities and household gyms to have multiple medicine balls of various weights. However, there can be drawbacks with this approach. Multiple medicine balls can take up a relatively vast amount of space. Further, switching medicine balls can expand the amount of time because the user switches from one medicine ball to another.

There are kettle bells and dumbbells with adjustable weight capacities. However, there are no known medicine balls with an adjustable weight capacity. One possible reason is that the addition and subtraction of weight in a medicine ball may change the size and shape of the medicine ball. An altered size or shape may not be suitable for the user. Further, the kettle balls and dumbbells do not have attachments to increase the intensity of the workout. Therefore, adjustable kettle bells and dumbbells still limit the user from performing certain exercises. In addition, the addition and subtraction of weights in equipment such as kettle bells and dumbbells changes the size and shape of the equipment, which can be undesirable to the user.

Others devices besides medicine balls are constructed in a relatively uncomfortable and dangerous form and, generally, there are difficulties in changing the weight. Therefore, it would be desirable to have a device that overcomes these aforementioned difficulties and problems.

Therefore, it is desirable for a medicine ball with an adjustable weight capacity so as to reduce workout time and to also increase space availability, all without altering the shape of the medicine ball. Further, it is also desirable for a medicine ball that can be adapted to engage with various exercise attachments so that the user can perform different exercises. In addition, it is desirable for a medicine ball that can feel relatively comfortable against a user's body so as to relatively reduce potential trauma, pain, and discomfort to the user.

Thus, a medicine ball addressing the aforementioned problems is desired.

SUMMARY OF THE INVENTION

Embodiments of a medicine ball are provided. The medicine ball includes a central member with a pair of opposing concave sides. Further, convex attachments are each adapted to mate with the concave sides of the central member so that a sphere is formed. These convex attachments are fastened together to the concave sides by a pair of fasteners, such as zippers. Additionally, attachment ports which can receive an exercise attachment are each positioned within the central member. Examples of exercise attachments include a barbell bar, a handgrip, and a pair of roller bars, among others. In an alternative embodiment the attachment ports are positioned within the convex attachments. Further details of the medicine ball include an article of clothing having at least one receptacle for receiving the convex attachments.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The medicine ball is an exercise device that can be used for exercising multiple areas of the body, such as the user's legs, chest and shoulders. The medicine ball includes removably securable convex attachments so that the weight of the medicine ball can be modified without altering the center of gravity of the overall medicine ball. Further, the medicine ball also has the capability to allow for an exercise attachment to be added to the medicine ball without, once again, altering the center of gravity of the medicine ball. Therefore, the medicine ball can be used as a medicine ball in and of itself and/or as an enhanced exercise device having add-on attachments for a variety of workouts from the user's creativeness and imagination.

The features of the medicine ball allow for a mass center to be located relatively more distal to the user's joint in comparison to exercise equipment such as dumbbells. The shape of the medicine ball is relatively comfortable to the user while exercising, and in particularly, in carrying out the basic exercises in comparison to exercise equipment such as dumbbells and kettle bells which are flipped over the handle and stopped on the back of the wrist. The medicine ball is conventionally filled with sand but may use other types of ballast, e.g. lead shot or water or other fluid.

Referring to FIGS. 1-6, a medicine ball 100 is disclosed. The medicine ball 100 includes a central member 102, which can be a molded component. The central member 102 of the medicine ball 100 has a specific weight capacity so that the central member 102 by itself can provide for a weighted resistance. As an example, the medicine ball 100 can have a total weight in the range of about 4 lbs. to 90 lbs. Therefore, the central member 102 can have a weighted capacity relatively in that range. Although not illustrated, the central member (and side members 104) may be equipped with a fill plug to allow for adjustment of the weight of the member. Conventional fill plus are disclosed in U.S. Pat. Nos. 3,231,270, 4,103,887, and 5,445,587, the disclosure being incorporated herein.

Figure 3:
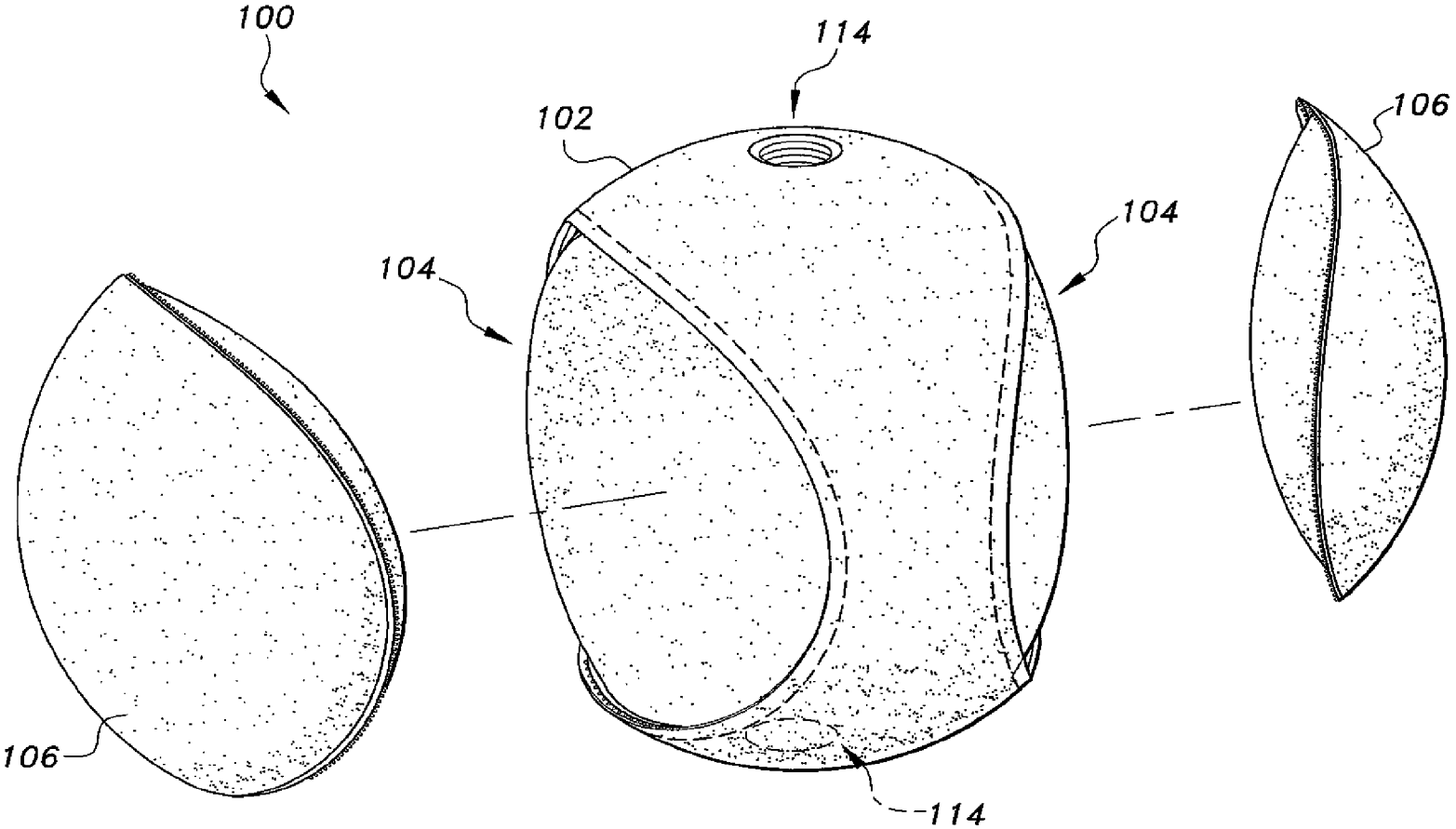
FIG. 3 is a perspective view of embodiments of a medicine ball with convex attachments in an unattached position in relation to a central member according to the present invention.

Continuing now with FIG. 3, the central member 102 includes a pair of opposing concave sides 104. These concave sides 104 are adapted to receive, mate and support a pair of convex attachments 106. Similar to the central member 102, each convex attachment 106 out of the pair of convex attachments 106 has a specific weight capacity. As an example, each convex attachment 106 could have a weight of 2 lbs., or, each convex attachment 106 could have a different weight from the other convex attachment 106. For example, one convex attachment 106 could have a weight of 2 lbs. while the other convex attachment 106 has a weight of 3 lbs., simply depending on the user's needs and preferences.

Concerning the central member 102, the weight of the central member 102 remains constant. Therefore, if a user desires to increase the weight of the medicine ball 100, this can be achieved by replacing the currently implemented convex attachments 106 with other convex attachments 106 having a relatively more suitable weight for the user. As an example, if the current total weight of the medicine ball 100 is 10 lbs., and the user desires for the total weight capacity to be 20 lbs., and the central member 102 is 8 lbs., the user would simply add convex attachments 106 having a weight of 6 lbs. each, for example. It is desirable for the weight of the convex attachments 106 to have a lesser or equal weight in relation to the weight of the central member 102. The convex attachments 106 can also be color-coded to allow for indication of weight capacity to a user. Regardless of the weight of the central member 102, the concave sides 104 of the central member 102 can receive and support the convex attachments 106. Each of the members (central member or convex attachments) can have indicia to indicate their respective weights, whereby a variable exercise medicine ball may be provided wherein the user may select various combinations of members to obtain the desired weighted medicine ball.

Figure 1:
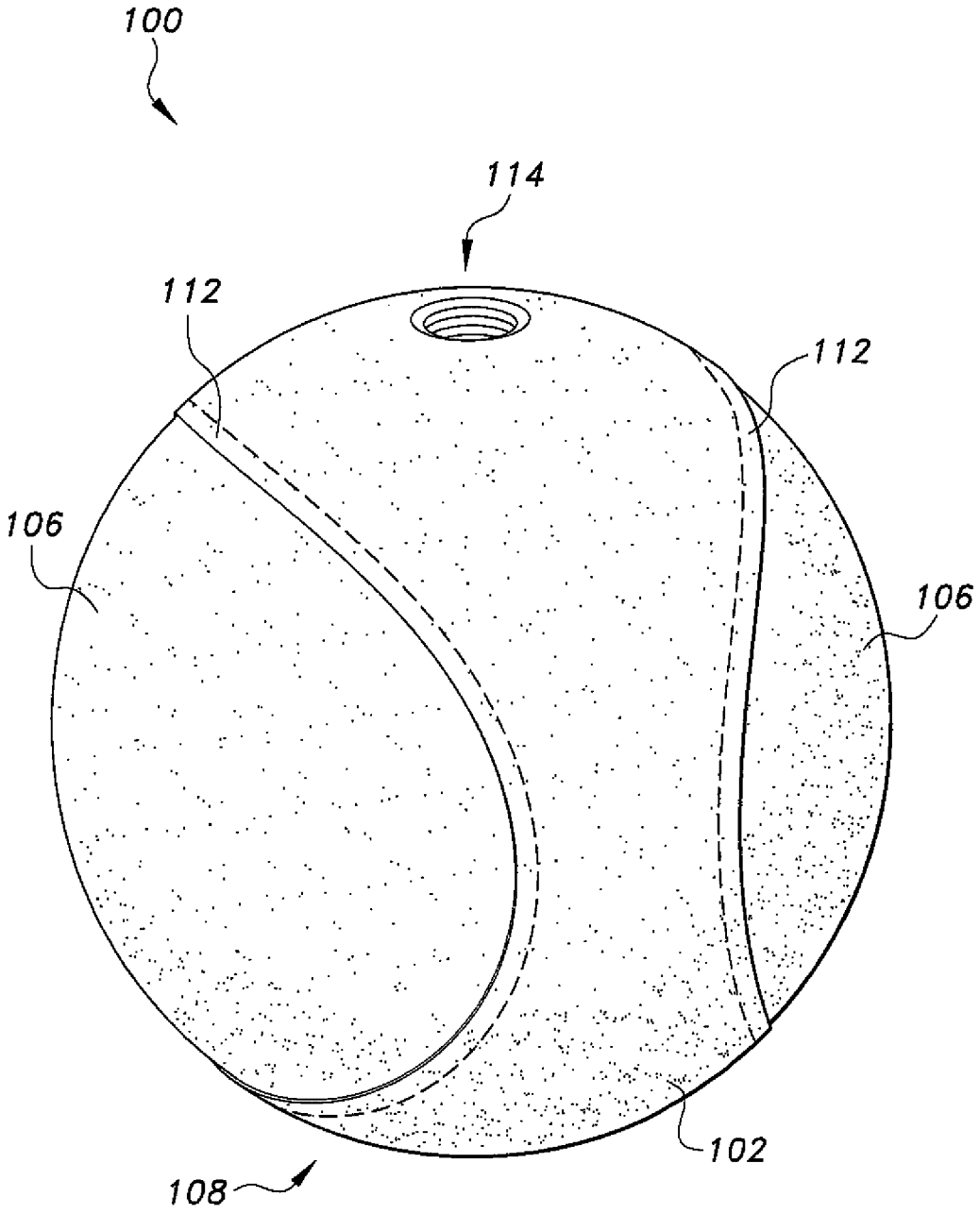
FIG. 1 is a perspective view of embodiments of a medicine ball according to the present invention.
Figure 2:
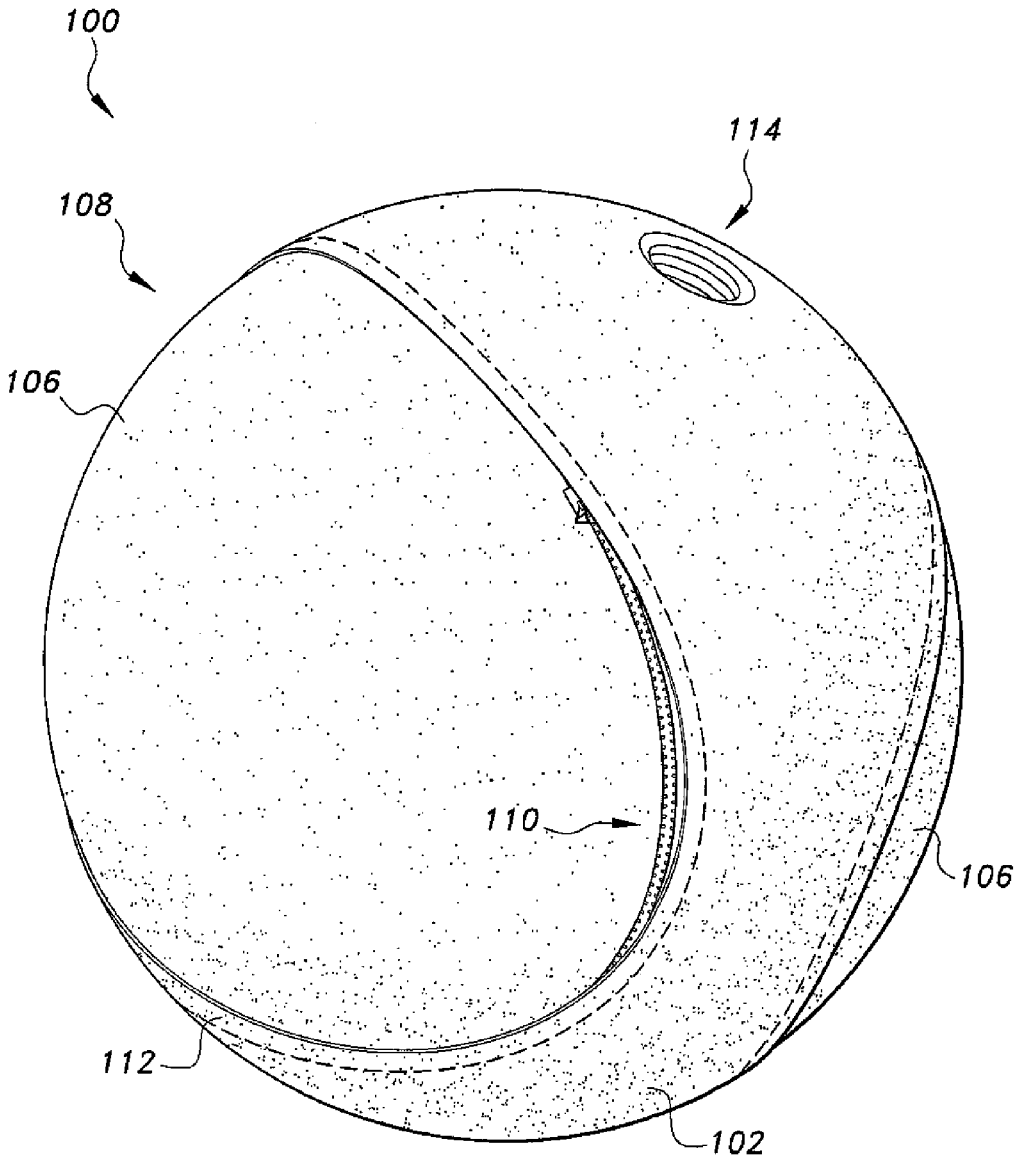
FIG. 2 is a perspective view detailing embodiments of a fastener for embodiments of a medicine ball according to the present invention.

The mating of the convex attachments 106 to the concave sides 104 of the central member 102 allows for the medicine ball 100 to form a sphere shape 108. This sphere shape 108 is not altered by the replacement of the convex attachments 106. Therefore, the addition and subtraction of weight and the changing of the overall weight of the medicine ball 100 does not alter the shape of the medicine ball 100. As illustrated in FIG. 2, fasteners 110 fasten together each convex attachment 106 mated to each concave side 104. The fasteners 110 can be zippers as illustrated in FIG. 2, or can be any other suitable fastener, depending on the user's needs. The fasteners 110 allow for the convex attachments 106 to be removably securable to the central member 102. Thus, the convex attachments 106 are tightly secured to the central member 102 so that no gaps are present in the medicine ball 100, which creates tightly secured overall device. As illustrated clearly in FIGS. 1-2, the fasteners 110 can be hidden and covered by a fastener cover 112. The fastener cover 112 can prevent the exposure of the fastener 110 to the user and also allows for a more overall uniform surface of the medicine ball 100.

In addition to the fasteners 110, the medicine ball 100 can include further locking and securing mechanisms. Both the fasteners 110 and the further locking and securing mechanisms prevent the convex attachments 106 from being disengaged in relation to the central member 102. As an example, each concave side 104 can include a groove that accepts an aperture from each convex attachment 106 so that each convex attachment 106 can slide and engage the concave side 104. In addition to these grooves, the central member 102 can also include locking mechanisms to further secure the convex attachments 106. These grooves and locking mechanisms can allow for a method of relatively safely locking and securing the convex attachments 106 so that the convex attachments 106 can be easily and quickly added and/or removed from the central member 102. The method can include the steps of sliding each convex attachment 106 one at a time in relation to each concave side 104. This step entails the user sliding each convex attachment 106 to engage the grooves. Next, the step of turning the locking mechanism of the central member 102 to the locked position.

Figure 4:
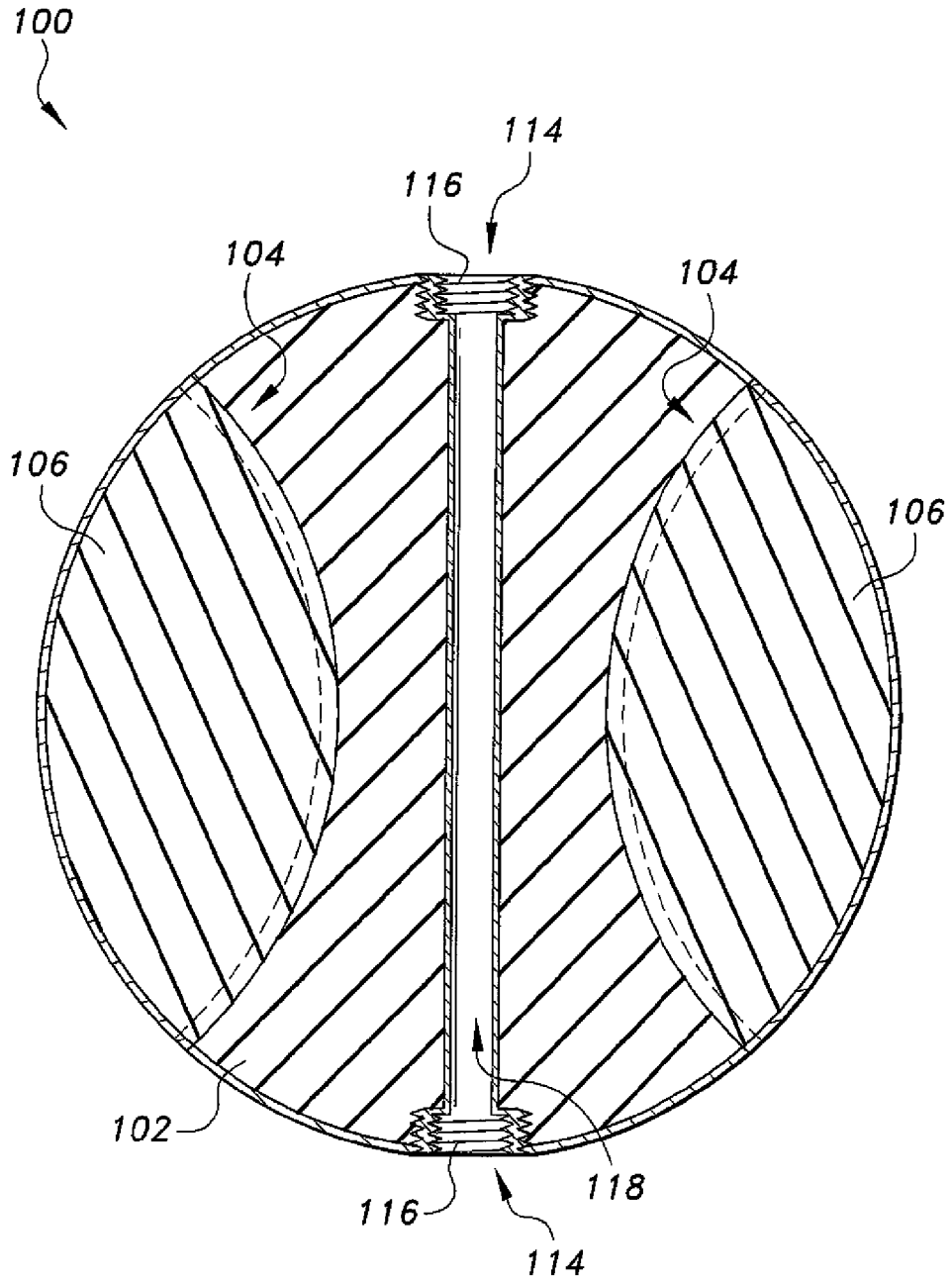
FIG. 4 is a cross sectional view of embodiments of a medicine ball according to the present invention.
Figure 5A:
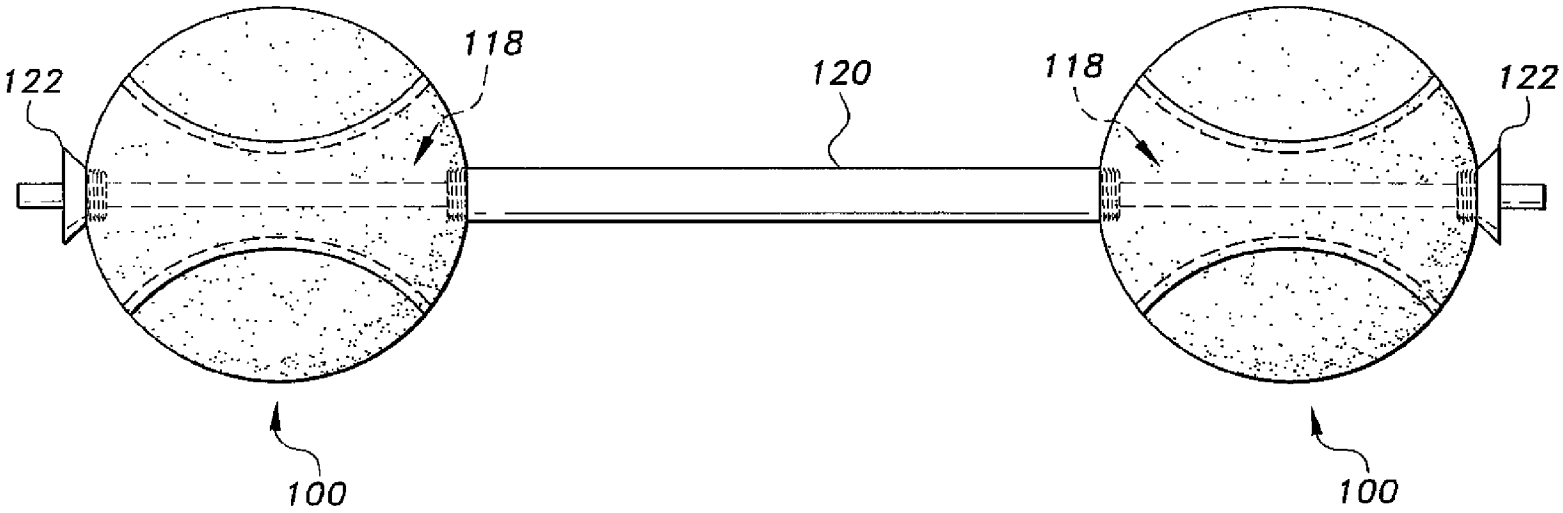
FIG. 5A is a front view of a plurality of embodiments of medicine balls attached together by a barbell bar according to the present invention.
Figure 5B:
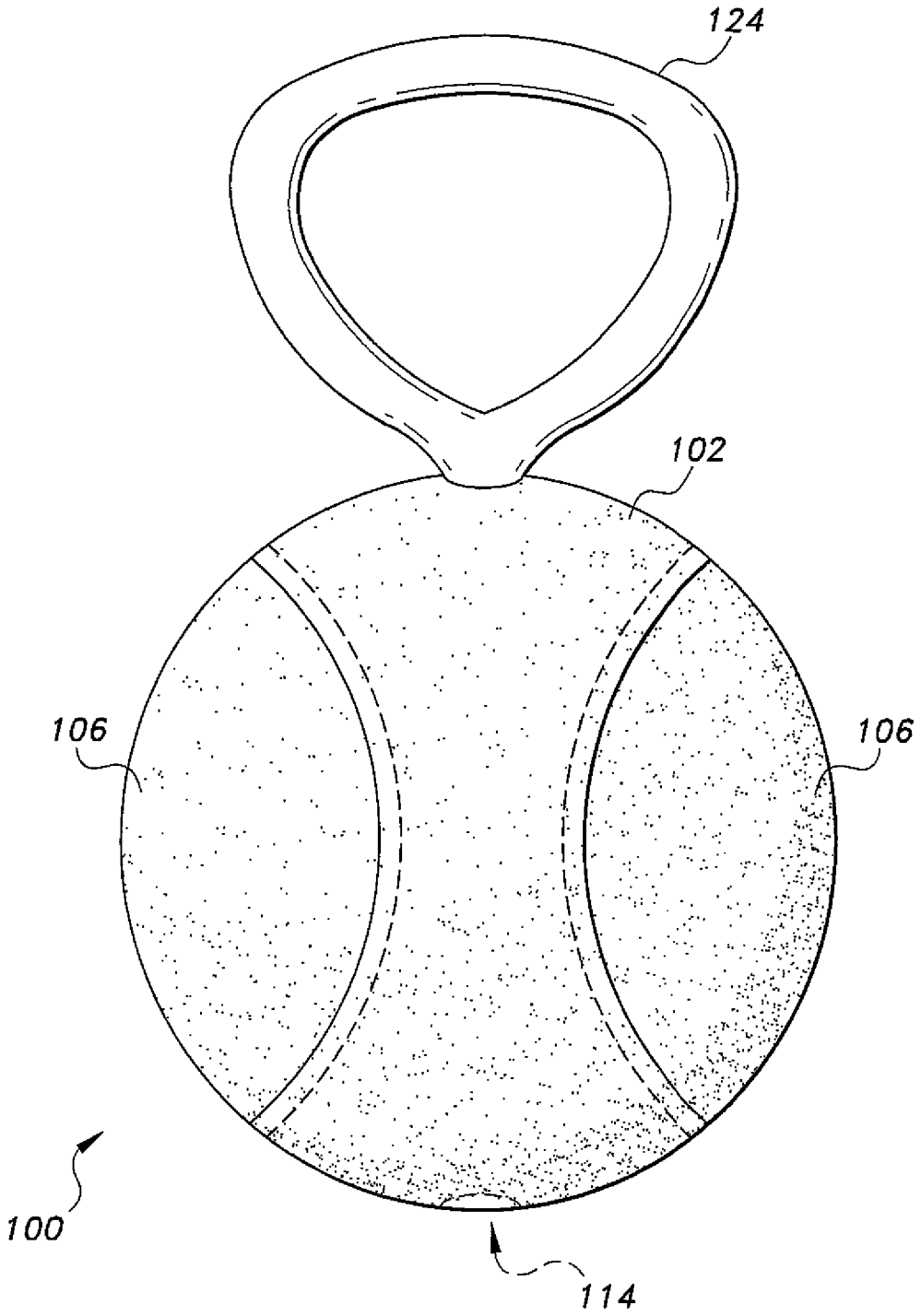
FIG. 5B is a front view of embodiments of a handgrip for embodiments of a medicine ball according to the present invention.
Figure 5C:
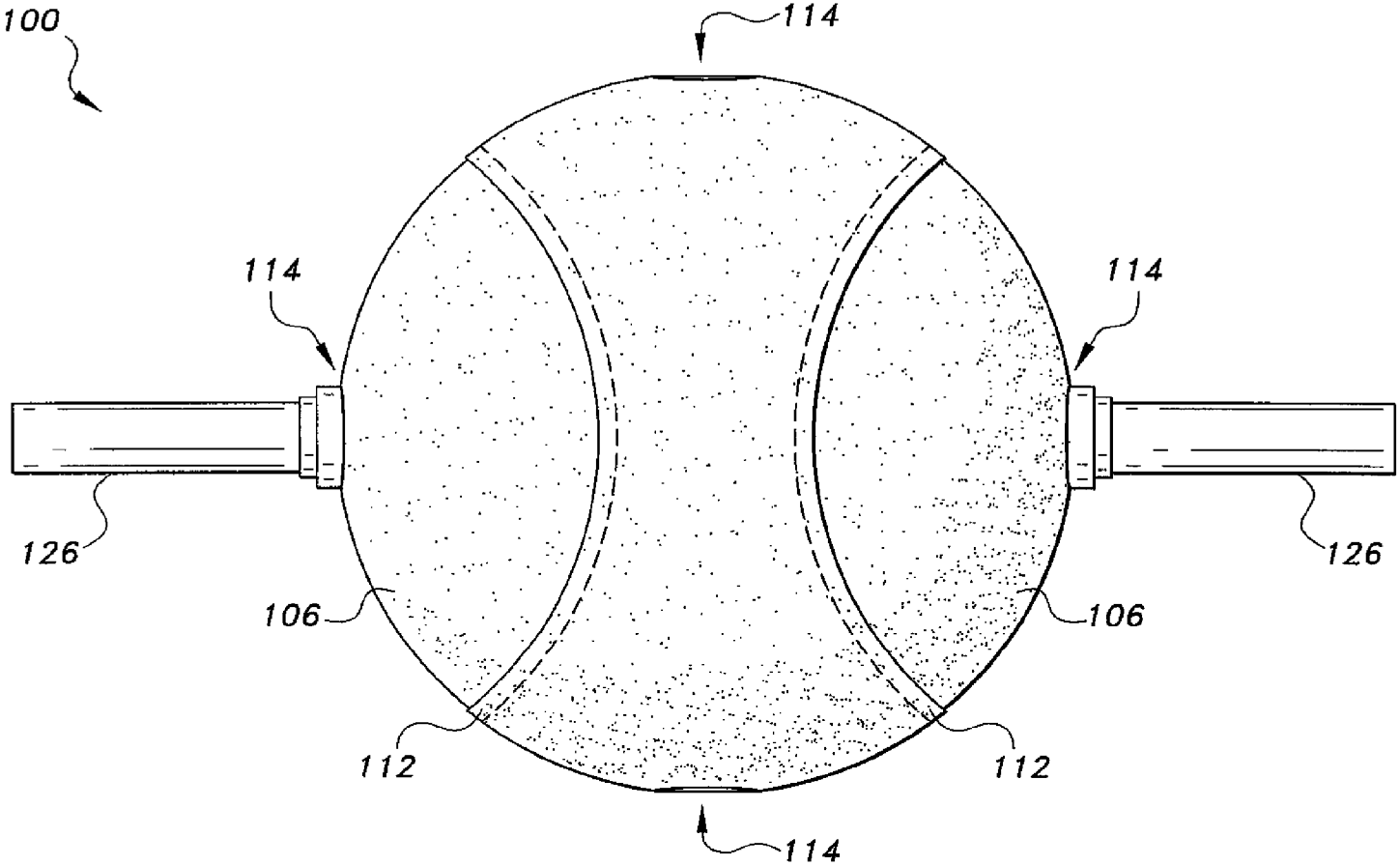
FIG. 5C is a front view of embodiments of roller bars for embodiments of a medicine ball according to the present invention.

As shown in FIGS. 1-5C, the central member 102 can also include at least one attachment port 114. The attachment port 114 can be positioned within the central member 102, for example in an upper region of the central member 102, among other examples. The attachment port 114 is adapted to receive an exercise attachment. As shown in FIG. 4, the attachment port 114 can include threads 116 to assist in attaching the exercise attachment the user implements together with the medicine ball 100. Further, if more than one attachment port 114 is present, a channel 118 can be formed between them, as illustrated in FIGS. 4 and 5A. In addition to the attachment ports 114 positioned within the central member 102, attachment ports 114 can also exist together with the convex attachments 106, as illustrated in FIG. 5C.

Referring to FIGS. 5A-5C, various exercise attachments are provided. These exercise attachments can allow for the medicine ball 100 to operate as a single source multi workout machine. As shown in FIG. 5A, the exercise attachment can be a barbell bar 120 with accompanying barbell stoppers 122. If the user so desires, the user can connect multiple medicine balls 100 together by using the barbell 120 and barbell stoppers 122. In FIG. 5B, the exercise attachment can be a handgrip 124, while in FIG. 5C, the exercise attachment can be a pair of roller bars 126. The roller bars 126 can allow the user to exercise their stomach muscles similar to a wheel roller exercise equipment with the added weight. In addition to the depicted exercise attachments of FIGS. 5A-5C, the exercise attachment can be a rope, a long handle bar, resistance bands, and a curved bar, among other examples.

Figure 6:
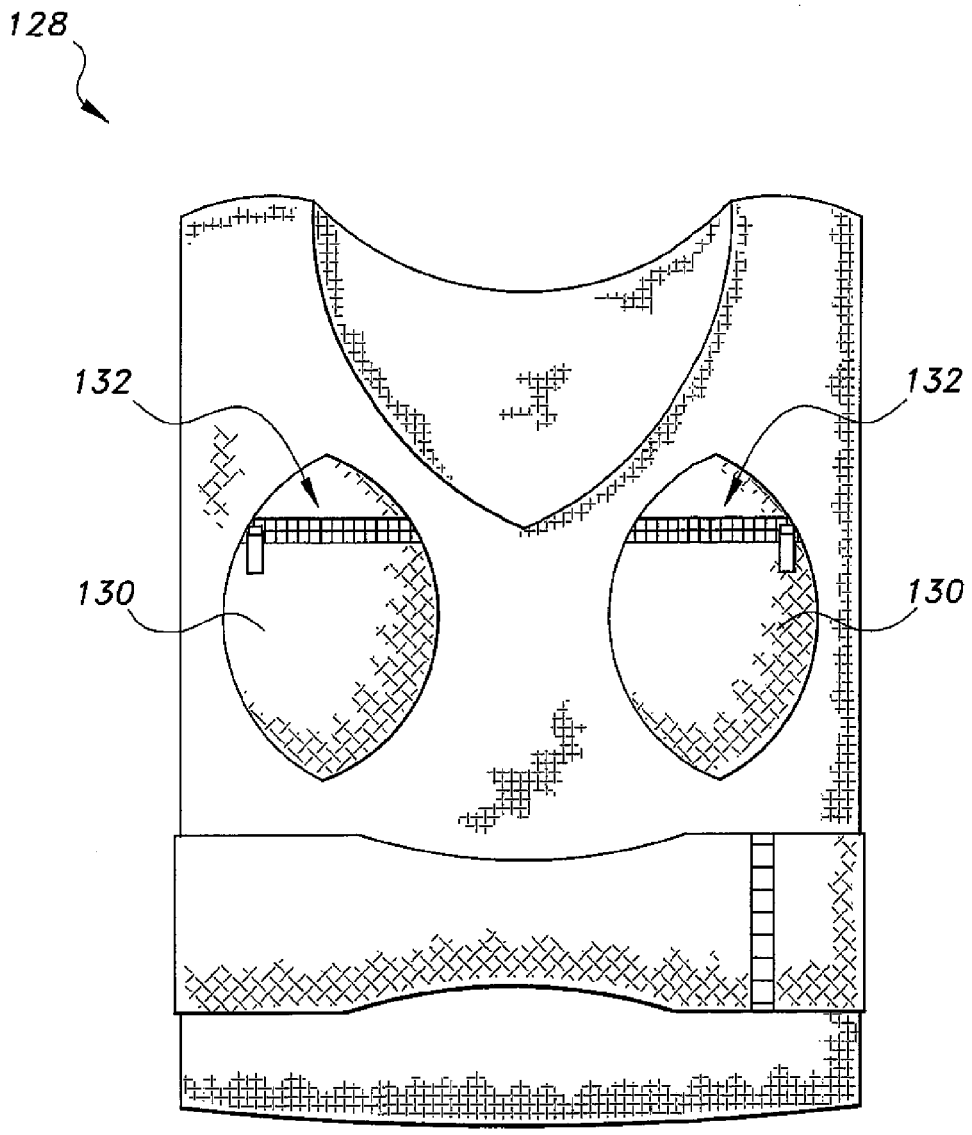
FIG. 6 is a front view of embodiments of a vest for embodiments of a medicine ball according to the present invention.

In addition to various exercise attachments, the medicine ball can also be implemented together with articles of clothing. As shown in FIG. 6, the medicine ball 100 can be implemented together with an article of clothing such as a vest 128. The vest 128 can include receptacles, such as pockets 130, to receive the convex attachments 106. These receptacles are of a form and shape that can accept and store the convex attachments 106. To further secure the convex attachments to the vest 128, the vest 128 can include zippers 132. Other articles of clothing besides a vest 128 can include a belt, a shirt, pants, or any other suitable clothing depending on the user's needs.

The medicine ball 100 and the exercise attachments and articles of clothing can provide a relatively total complete and time saving workout routine. One of the typical exercises that can be performed with the medicine ball 100 is for the user to place their feet in a foot attachment that is attached to resistance bands and the medicine ball 100 in the user's hands. The user then bends their knees and lifts the medicine ball 100 shoulder high. From this point, the user places their hands underneath the medicine ball 100 and proceeds to lift the medicine ball 100 above their head. This exercise can strengthen the user's legs, chest, and shoulders. Further, this exercise is generally different from a typical dumbbell implemented exercise because the mass of the circular form of the medicine ball 100.

The medicine ball 100 and its various components can come in various materials. However, it is desirable for the materials used to be a flexible, soft and strong, heavy material. Examples of heavy materials include leather, rubber, plastic (e.g. vinyl) and any other similar materials. Further, it is desirable for each of the central member 102 and the convex attachments 106 to be constructed as one-piece units.

It is to be understood that the present invention is not limited to the embodiments described above, but encompasses any and all embodiments within the scope of the following claims.

I claim:

1. A spherical medicine ball, comprising:

a central weighted member, the central weighted member having a pair of opposing sides, each of the opposing sides including a fastener; and a pair of weighted attachment members, each of the weighted attachment members including a fastener, wherein each weighted attachment member is adapted to be fastened with the sides of the central weighted member so as to faun the spherical medicine ball.

2. The spherical medicine ball according to claim 1, wherein the fasteners are zippers.

3. The spherical medicine ball according to claim 1, further comprising:

at least one attachment port, the attachment port positioned on the central member and adapted to receive an exercise attachment.

4. The spherical medicine ball according to claim 3, wherein the attachment port comprises a pair of attachment ports disposed at opposite ends of the central member.

5. The spherical medicine ball according to claim 1, further comprising:

at least one attachment port, the attachment port positioned on each of the attachment members and adapted to receive an exercise attachment.

6. The spherical medicine ball according to claim 3, wherein the exercise attachment is a barbell bar.

7. The spherical medicine ball according to claim 3, wherein the exercise attachment is a handgrip.

8. The spherical medicine ball according to claim 5, wherein the exercise attachment is a pair of roller bars.

9. The spherical medicine ball according to claim 1, wherein the central member defines a pair of opposing concave sides and each of the attachments are convex and adapted to mate with the concave sides of the central member so as to form a sphere.

10. The spherical medicine ball according to claim 3, wherein each attachment port is threaded.

11. The spherical medicine ball according to claim 4, wherein each attachment port is threaded.

12. The spherical medicine ball according to claim 5, wherein each attachment port is threaded.

13. A variable resistance exercise kit for assembling an exercise implement, the kit comprising:

a central weighted member, the central member having a pair of opposing sides, each of the opposing sides including a fastener;

a plurality of weighted attachments, each of the attachments including a fastener, wherein each attachment is adapted to be fastened with the sides of the central member; and at least one attachment port, the attachment port positioned within the central member and adapted to receive an exercise attachment.

14. The variable resistance exercise kit according to claim 13, wherein the fasteners are zippers.

15. The variable resistance exercise kit according to claim 13, further comprising:

a pair of attachment ports adapted to receive an exercise attachment, each attachment port positioned within the weighted attachments so that each exercise attachment is attached to at least one of the weighted attachments.

16. The variable resistance exercise kit according to claim 13, further comprising:

an article of clothing, the article of clothing having at least one receptacle for receiving a selected one of the central weighted member or weighted attachments.

17. The variable resistance exercise kit according to claim 13, farther comprising:

an exercise attachment, the exercise attachment being selected from the group consisting of a barbell bar, a handgrip, and roller bars.

* * * * *